US007546644B2

(12) United States Patent
Bignon et al.

(10) Patent No.: US 7,546,644 B2
(45) Date of Patent: Jun. 16, 2009

(54) PROTECTIVE GLOVE

(75) Inventors: Lucas Bignon, Cachan (FR); Mathieu Lion, Paris (FR)

(73) Assignee: Mastrad SA, Paris (FR)

( * ) Notice: Subject to any disclaimer, the term of this patent is extended or adjusted under 35 U.S.C. 154(b) by 0 days.

(21) Appl. No.: 10/293,884

(22) Filed: Nov. 13, 2002

(65) Prior Publication Data

US 2003/0126669 A1 Jul. 10, 2003

Related U.S. Application Data

(63) Continuation-in-part of application No. 10/002,756, filed on Nov. 14, 2001, now Pat. No. 6,532,597.

(30) Foreign Application Priority Data

Dec. 22, 2000 (FR) ..... 00 16910

(51) Int. Cl.
*A41D 19/00* (2006.01)

(52) U.S. Cl. ..... 2/161.6; 2/16; 2/163; 15/227

(58) Field of Classification Search ..... 2/16, 2/20, 158, 161.6, 163, 167, 168, 161.8, 161.1; 15/227; D28/115; D29/115, 118; 351/43; 16/110.1, 111.1, 430, 422, 426
See application file for complete search history.

(56) References Cited

U.S. PATENT DOCUMENTS

| | | | | |
|---|---|---|---|---|
| 61,841 | A | 2/1867 | Lewis | |
| 1,279,855 | A * | 9/1918 | Garvey | 2/168 |
| 1,990,553 | A * | 2/1935 | Hirsch et al. | 2/20 |
| 2,187,430 | A * | 1/1940 | Olmsted et al. | 2/168 |
| 2,229,837 | A | 1/1941 | Clafft | 2/168 |
| D183,522 | S | 9/1958 | Jackman | |
| 2,889,556 | A * | 6/1959 | Mehler | 2/158 |
| D188,035 | S | 5/1960 | Mackay | |
| 3,148,125 | A | 9/1964 | Velonis et al. | 264/301 |
| 3,918,096 | A * | 11/1975 | Lim | 2/161.1 |
| D268,222 | S | 3/1983 | Chen | |
| 4,411,026 | A * | 10/1983 | Secter | 2/158 |
| 4,603,439 | A * | 8/1986 | Golomb | 2/18 |

(Continued)

FOREIGN PATENT DOCUMENTS

| | | |
|---|---|---|
| CN | 2127297 Y | 2/1993 |

(Continued)

OTHER PUBLICATIONS

En Ree En Maires La Plastique Des Plastiques, French document, Jun. 1999.*

(Continued)

*Primary Examiner*—Katherine Moran
(74) *Attorney, Agent, or Firm*—Mark Montague; Cowan, Liebowitz & Latman, P.C.

(57) ABSTRACT

The present invention provides a glove, in particular for housework, the glove being made integrally of silicone material comprising a main pocket designed to receive four fingers of a user, and a secondary pocket designed to receive the thumb, said secondary pocket opening out into the main pocket, the glove including projecting ribs or reinforcement on at least one of its inside or outside surfaces.

7 Claims, 9 Drawing Sheets

U.S. PATENT DOCUMENTS

| | | | | | |
|---|---|---|---|---|---|
| 4,628,544 | A | * | 12/1986 | Erickson | 2/158 |
| 4,660,228 | A | * | 4/1987 | Ogawa et al. | 2/167 |
| 4,845,781 | A | * | 7/1989 | Strickland et al. | 2/161 |
| 4,916,757 | A | * | 4/1990 | Berlin et al. | 2/159 |
| 5,020,160 | A | * | 6/1991 | Cano | 2/159 |
| 5,134,746 | A | * | 8/1992 | William | 15/227 |
| 5,361,415 | A | | 11/1994 | Deering et al. | |
| 5,452,478 | A | * | 9/1995 | Rombach et al. | 2/161.6 |
| 5,625,900 | A | * | 5/1997 | Hayes | 2/161.8 |
| 5,807,296 | A | * | 9/1998 | Stubbs | 602/41 |
| 5,862,916 | A | | 1/1999 | Utecht | 206/570 |
| 5,878,438 | A | * | 3/1999 | Ragsdale | 2/158 |
| 5,907,870 | A | * | 6/1999 | Monroe et al. | 2/161.7 |
| 5,953,756 | A | * | 9/1999 | Vrissimdjis | 2/168 |
| 6,092,238 | A | | 7/2000 | Fierabend, Jr. | |
| 6,199,211 | B1 | * | 3/2001 | Franzolino | 2/161.6 |
| 6,203,080 | B1 | * | 3/2001 | Surplus | 294/1.3 |
| 6,298,488 | B1 | * | 10/2001 | Duncan et al. | 2/158 |
| 6,305,023 | B1 | * | 10/2001 | Barkes | 2/158 |
| 6,374,417 | B1 | * | 4/2002 | Stagnitta | 2/161.8 |
| D477,690 | S | * | 7/2003 | Howell et al. | D29/118 |
| 2002/0010957 | A1 | * | 1/2002 | Katz | 2/161.7 |

FOREIGN PATENT DOCUMENTS

| | | | |
|---|---|---|---|
| DE | 19837247 | | 7/1999 |
| DE | 19837247 | A1 | 8/1999 |
| GB | 2374273 | | 2/2003 |
| JP | 07-082603 | | 3/1995 |
| WO | PCT/FR01/04067 | | 11/2002 |

OTHER PUBLICATIONS

En Ree En Maires La Plastique Des Plastiques, No. 16, Jun. 1999, (3 pages); English language translation (3 pages).
Lakeland Limited; shopping advertisement; 2 pages; Oct. 2000.
Lakeland Limited; shopping advertisement; 2 pages; Winter 1999.
Evasolo advertisement; 6 pages; 1999.

* cited by examiner

PROTECTIVE GLOVE

The present patent application is a Continuation-in-Part of application Ser. No. 10/002,756, filed Nov. 14, 2001 now U.S. Pat. No. 6,532,597.

BACKGROUND OF THE INVENTION

Numerous types of gloves have already been proposed, differing in particular in shape and/or in the material from which they are made.

Nevertheless, no presently available glove gives full satisfaction for housework.

In particular, known gloves are poor at withstanding heat, flame, aggressive chemicals; they do not provide any protection against scalding, by steam, oil, water, etc.

OBJECT AND SUMMARY OF THE INVENTION

The object of the present invention is to provide a novel glove presenting properties better than those of known prior gloves.

In the context of the present invention, this object is achieved by a glove, in particular for housework, the glove being made integrally of silicone material comprising a main pocket designed to receive four fingers of a user, and a secondary pocket designed to receive the thumb, said secondary pocket opening out into the main pocket, the glove including projecting ribs or reinforcement on at least one of its inside or outside surfaces.

The term "made integrally of silicone material" means, in the context of the present invention, that the glove is made out of silicone material alone without any other component material, and in particular without any fabric reinforcement or the equivalent.

According to a preferential feature of the invention, the glove is "ambidextrous". That means that the glove has a plane of symmetry and can be used equally well by a left-handed user as by a right-handed user.

BRIEF DESCRIPTION OF THE DRAWINGS

Other characteristics, objects, and advantages of the present invention will appear on reading the following detailed description and on looking at the accompanying drawings given by way of non-limiting example, and in which.

MORE DETAILED DESCRIPTION

First Embodiment

The accompanying figures show an ambidextrous glove 10 made entirely out of silicone material.

The glove 10 is in the form of a glove. I.e. the glove 10 of the invention has a single separation, for the thumb only.

Still more precisely, the glove 10 comprises a main pocket 20 for receiving four fingers, namely the index, the middle, the ring, and the little fingers.

The pocket 20 has a generally oblong opening 22 which is typically elliptical in shape in use. It preferentially has also the shape of an open mouth.

Figure 11:
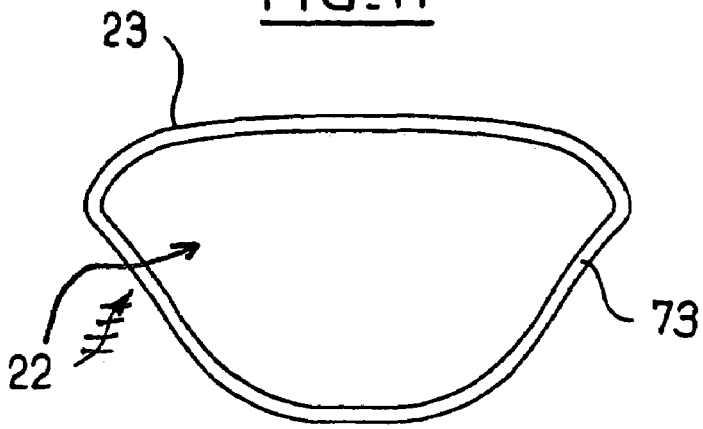
FIG. 11 is a view of the outline of the glove.

A cross section of the opening 22 is more precisely shown in FIG. 11. In this figure, the back 23 of the glove can be seen at the top of the FIG. 11. The back 23 has an arcuate line, the convexity of the line being towards the exterior of the glove. The front of the glove, situated below the back 23 in FIG. 11, possesses a general shape of a 'U', whose upwards panels converge towards the extremities of the arcuate line of the back 23 of the glove. The concavity of the converging panels is turned towards the exterior of the glove. The inferior elbow of the 'U' has on the contrary a concavity tuned towards the interior of the glove 10.

The opening 22 possesses a swage 73 along its edge. Both the back 23 and the swage 73 will be described later in the present specification.

Figure 1:
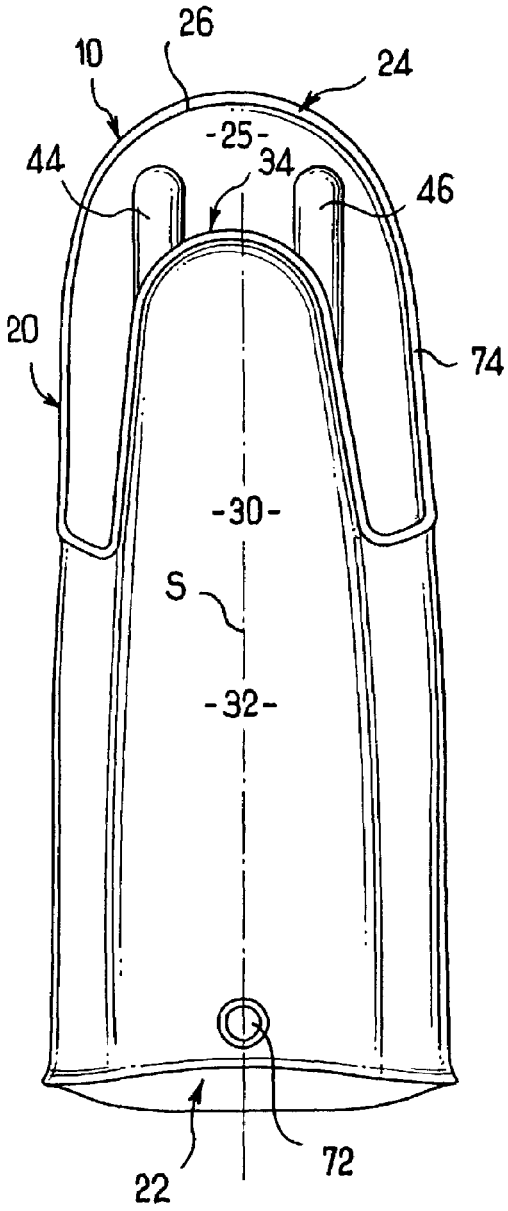
FIG. 1 is a first plan view of a first embodiment of a glove of the present invention, as seen from beneath.
Figure 2:
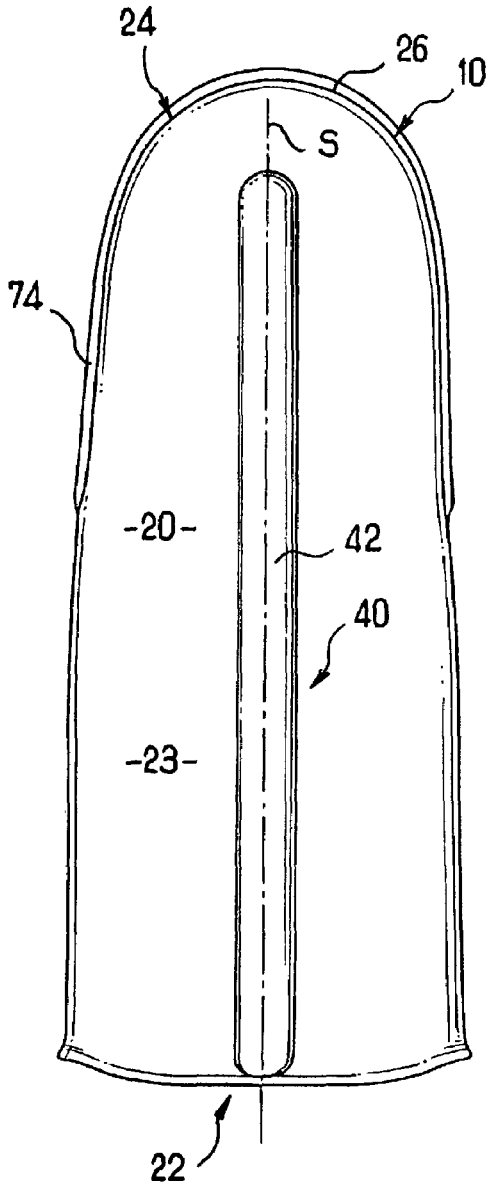
FIG. 2 is a second plan view of a glove of the present invention according to FIG. 1, as seen from above.

Referring now to FIG. 1 and FIG. 2, it can be seen that from this opening 22, the main pocket 20 tapers progressively in section. The main pocket 20 is generally rounded and closed at its end 24 remote from the opening 22. At this end 24, the main pocket 20 has an outwardly convex curved tip 26. The longitudinal axis of the main pocket is referred to as 70 in FIG. 3.

The glove 10 also has a secondary pocket 30 for receiving the thumb.

The secondary pocket 30 is connected to the main pocket 20 and opens out into it substantially halfway along the main pocket 20.

The secondary pocket 30 also tapers progressively in section from its open outline 32 that opens out into the main pocket.

At its opposite end, the rounded secondary pocket 30 is closed by a curved tip 34.

The length of the secondary pocket 30 is shorter than the length of the main pocket 20. The longitudinal axis of the secondary pocket is referred to as 71 in FIG. 3.

As mentioned above, the glove 10 possesses a plane of symmetry. This plane of symmetry is referenced S in the accompanying figures. The plane of symmetry S is perpendicular to the plane of FIGS. 1, 2, and 4, and parallel to the plane of FIG. 3. In other words, the plane of symmetry is passing through the longitudinal axes 70 and 71 of the pockets.

In the first embodiment, the axes are mainly parallel to each other.

A rib 74 runs continuously along the tip 26 of the main pocket 26 and the tip of the secondary pocket 34. The rib 74 runs as well along the sides of the main pocket 20 and the secondary pocket so as to form a continuous 'lip' along the zone where the two pockets connect and the tips 26 and 34. The cross section of the rib 74 is semi-circular. The rib 74 acts as a reinforcement of the glove and prevents the finger tips and the sides of the fingers from being burnt when approaching a hot member. The thickness of the glove at those locations is indeed higher and will therefore provide protection against heat. The glove may possess more than a lip as well.

Figure 3:
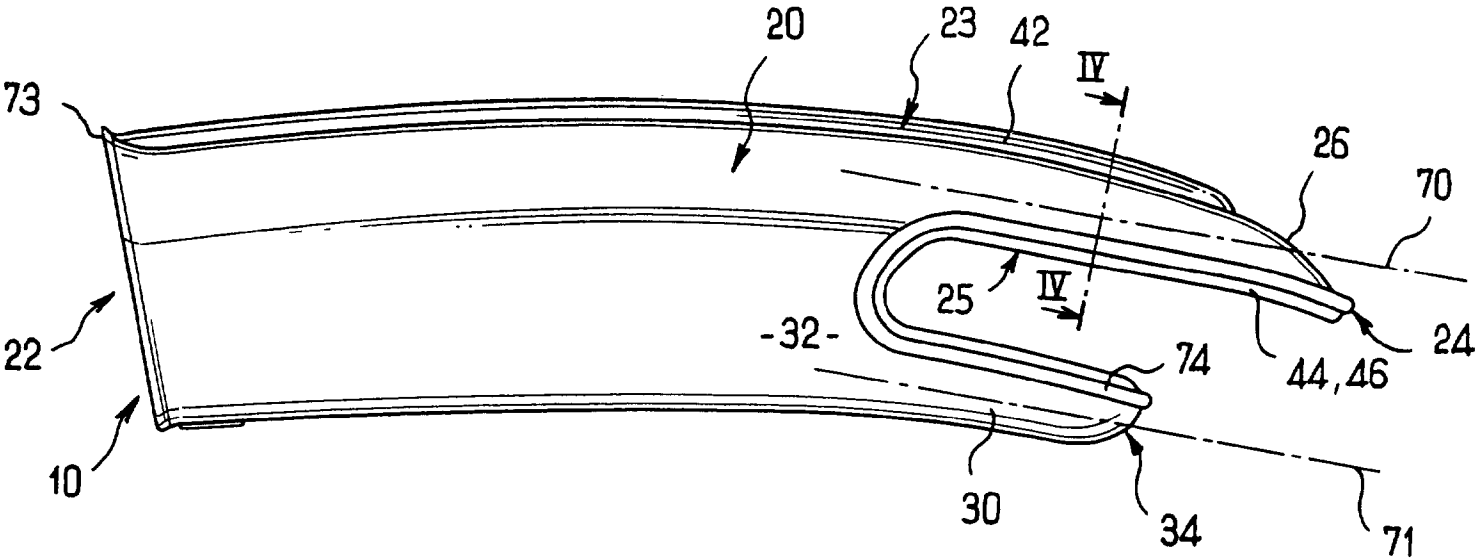
FIG. 3 is a side view of the same first embodiment of a glove of the present invention.

As seen in FIG. 3, in the invention, the rear face 23 of the main pocket 20 which forms the back of the glove remote from the secondary pocket 30 is preferably curved and outwardly convex. Conversely, the front face 25 of the main pocket 20 is generally concave towards the secondary pocket 30 for receiving the thumb. In other words, the concavity of the front face 25 is towards the secondary pocket 30, and the convexity of the front face 25 is turned towards the inside of the glove 10.

Having the main pocket 20 in a rounded shape in this way makes it easier for the user to put the hand inside the glove.

Where appropriate, it is possible to include projecting reinforcement or ribs on the inside face or the outside face or indeed both faces, both of the main pocket 20 and of the secondary pocket 30. In addition to the reinforcing effect, such ribs reduce contact between the glove and objects that are being handled, and consequently limit the transfer of heat to the hand of the user.

In a preferred version of this first embodiment of the invention, the figures thus show three ribs 40: a central longitudinal rib 42 on the back 23 and two parallel longitudinal ribs 44 and 46 on the front face 25 above the zone that connects with the secondary pocket 30.

Each rib has preferably a cross section that has a semi circular shape.

Figure 4A:
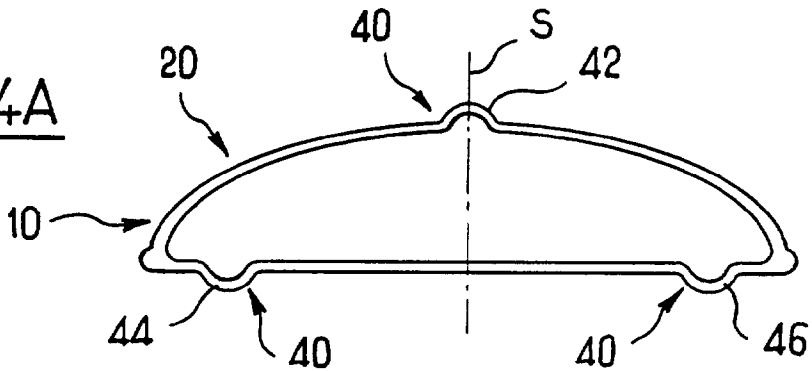
FIGS. 4A to 4C are fragmentary section views on section plane IV-IV of FIGS. 3 and 7, these section views being possibly adapted to different embodiments of the invention.
Figure 4B:
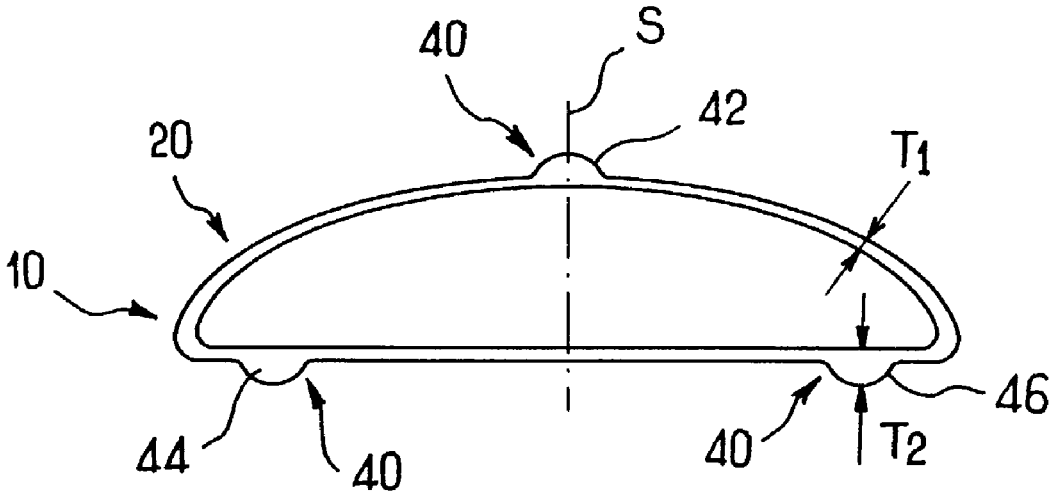
Figure 4C:
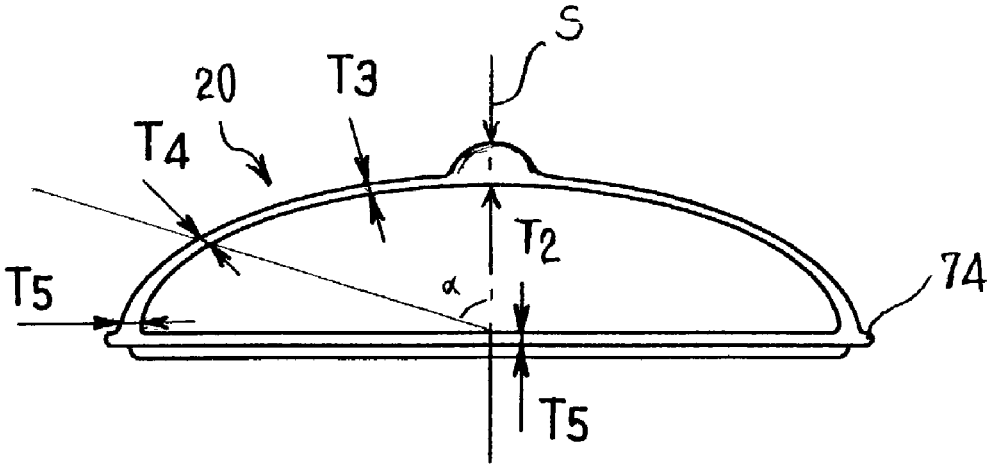

The width of the central longitudinal rib 42 is approximately equal to 1.5 cm and as shown in FIGS. 4A to 4C, it has a radius of curvature. Preferentially, the radius of curvature is approximately equal to 7.5 mm.

The glove of the present invention can naturally be embodied in numerous ways concerning its particular shape and its dimensions, nevertheless in a preferred version of the first embodiment:

- when flat, the length of the opening 22 is about 13 centimeters (cm);
- in use, the section of the opening 22 is about 30 square centimeters ($cm^2$);
- the total length of the main pocket is about 25 cm;
- the length of the secondary pocket 30 is about 8 cm;
- the length of the secondary pocket 30 in the flattened state, across its opening outline 32 where it joins the main pocket 20 is about 9 cm; and
- the width of the main pocket 20 in the flattened state, at a distance of about 20 cm from its opening outline is about 9 cm.

An eyelet 72 is situated near the opening 22. The center of the eyelet 72 is approximately situated at 1.5 cm from the verge of the outline. The diameter of the eyelet is approximately 1 cm.

FIG. 3 shows that the verge of the opening 22 has a swage 73 which is turned towards the exterior of the opening 22 and of the glove 10. The swage 73 prevents liquids flowing off from parts 24 and 34 on the surface of the glove 10 from entering into the glove and touching the skin of a user. This might be useful in case of hot or aggressive liquids.

The swage 73 prevents as well the skin of the fore-arm of a user from touching a hot body. This may occur when the user puts his arm in an oven for instance.

Different forms of cross section can be adapted to the main pocket 20 at the location of the gripping part, that is to say the part facing the secondary pocket 30. These different forms can be seen in FIGS. 4A to 4C.

FIG. 4A shows that the thickness T1 of some embodiments of the glove may be a constant all along the cross section of the main pocket 20. T1 is at least equal to 1.5 mm.

FIG. 4B shows that the thickness of the glove may be increased at the location of the ribs, in particular at the location of the longitudinal rib 42 situated at the back 23 of the glove 10. Thus, the thickness T1 is at least 1.5 mm, and the thickness T2 where there are ribs is at least equal to 2.5 mm. Preferentially, the thickness T2 is equal to 5 mm.

FIG. 4C shows that the thickness on the back 23 of the glove 10 at the level of the plane of symmetry S and where the central longitudinal rib 42 is situated is equal to T2. That is to say that it is preferably at least equal to 2.5 mm, preferentially equal to 5 mm. Then, from this plane of symmetry S, the thickness increases to the sides of the glove. Therefore, the thickness T3 near the plane S is at least equal to 1.8 mm. The thickness T4 at an inclination of alpha from S of approximately 60. degree. is at least equal to 2 mm. The thickness T5 just before the rib 74 is at least equal to 2.5 mm. The increased thicknesses provide better heat protection.

The structure of the inner surface of the glove is cellular. This structure allows a greater air circulation. Therefore, heat can be evacuated more easily. It improves protection of the user against heat. It improves comfort as well, as it allows evaporation of sweat off the hand of the user. The hand of the user is therefore less humid. The cellular structure prevents adherence of the inner glove surface on the surface of the hand and makes it easier for the user to put the hand inside the glove.

The glove has been described having a central longitudinal rib 42 along its back. Of course, other ribs can be imagined, for instance two or more longitudinal ribs, located as well on the back of the glove.

The distance on which the longitudinal rib extends can also be changed. For instance, the longitudinal rib can run on half the length of the glove, from the tip 24 of the main pocket.

The thickness of the glove around the gripping part—that is to say the thickness of the glove facing the fingers and the thumb when the glove is in use—can be of at least 2.5 mm and preferably of 5 mm. The increased thickness provides better protection for the fingers of the user when really hot bodies have to be handled. This alternative can be made for all the embodiments described in the following specification.

Second Embodiment

Figure 6:
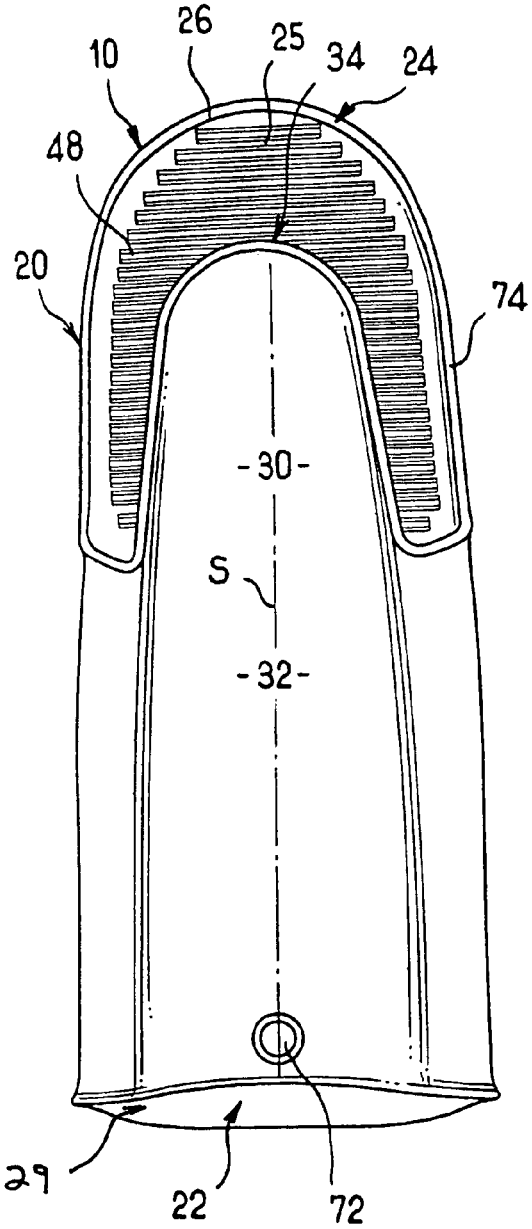
FIG. 6 is a first plan view of a second embodiment of a glove of the present invention, as seen from beneath.
Figure 7:
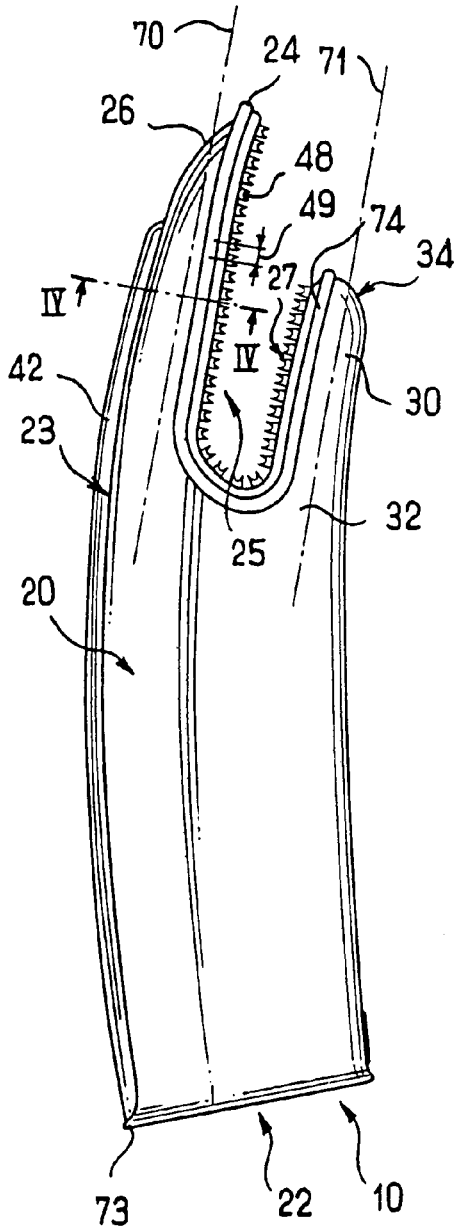
FIG. 7 is a second plan view of a second embodiment glove of the present invention, as seen from above.

The glove according to a second embodiment is shown in FIGS. 6 and 7.

It has the same overall shape as the glove of the first embodiment, and the numerical references show this similarity.

The glove 10 is a glove and has a main pocket 20 and a secondary pocket 30, opening out in the main pocket.

The forms of the pocket are similar to what is described for the first embodiment.

Therefore, the back of the glove according to the second embodiment is exactly similar to the FIG. 2. It possesses a central longitudinal 42 rib on the back 23. As for the first embodiment, the longitudinal axes 70 and 71, which can be seen in reference to FIG. 7, are mainly parallel to each other.

The glove 10 possesses a plane of symmetry. This plane of symmetry is referenced by S in FIGS. 6 and 7. The plane of symmetry S is perpendicular to the plane of FIG. 6, and parallel to the plane of FIG. 7. In other words, the plane of symmetry is passing through the longitudinal axes 70 and 71 of the pockets.

A continuous rib 74 runs all along the tip 26 of the main pocket 26 and the tip of the secondary pocket 34, and along the sides of the main pocket 20 and the secondary pocket.

The dimensions of the second embodiment are mainly the same as in the first embodiment:

- when flat, the length of the opening 22 is about 13 centimeters (cm);
- in use, the section of the opening 22 is about 30 square centimeters ($cm^2$);
- the total length of the main pocket is about 25 cm;
- the length of the secondary pocket 30 is about 8 cm;
- the length of the secondary pocket 30 in the flattened state, across its opening outline 32 where it joins the main pocket 20 is about 9 cm; and
- the width of the main pocket 20 in the flattened state, at a distance of about 20 cm from its opening outline is about 9 cm.

An eyelet 72 is as well situated near the opening 22. The center of the eyelet 72 is approximately situated at 1.5 cm from the verge of the outline, and its diameter is 1 cm.

FIG. 7 shows that the verge of the opening 22 has a swage 73 which is turned towards the exterior of the opening 22 and of the glove.

The thickness of the glove in the first embodiment is always greater than 1.5 mm.

The structure of the inner surface 29 (FIG. 6) of the glove is cellular.

The front face 25 of the main pocket 20 and the back face 27 of the secondary pocket possess small transverse ribs 48. The extension of the ribs is perpendicular to the extension of the longitudinal axes 70 and 71 and the longitudinal rib 42.

Figure 8:
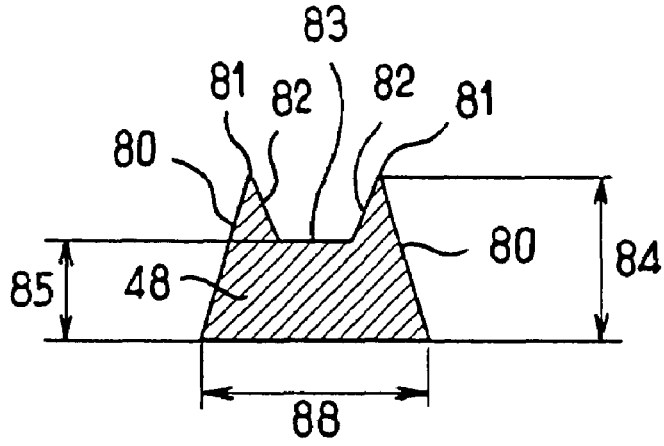
FIG. 8 is a detailed view of a first embodiment of ribs on the surface of the gloves of the present invention.

The ribs 48 have preferentially a general shape of an "M" as shown in FIG. 8. Each rib has therefore two panels 80 converging upwards on FIG. 8. The panels 80 extend to a height 84 of approximately 5 mm. Two panels 82 converge downwards from a climax 81 to a central table 83. The height 85 of the central table 83 is approximately 4 mm.

The specific shape of the rib provides an anti-slide surface, thanks to the climaxes 81 of the ribs 48. The ribs define therefore a grip.

Moreover, the fact that there is a difference in height between 84 and 85 allows a circulation of air in the rib. The circulation occurs between the hot body and the table 83. Therefore, heat transfer from the hot body to the glove and the hand of a user is limited.

Figure 9:
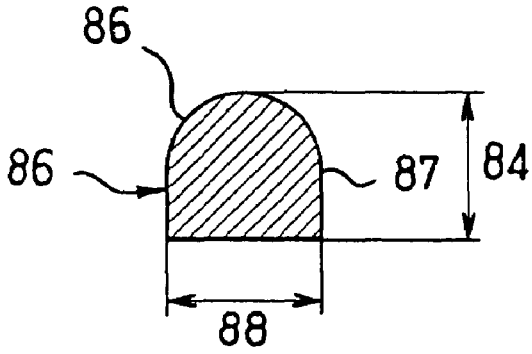
FIG. 9 is a detailed view of a second embodiment of ribs on the surface of the gloves of the present invention.

Other embodiments of the ribs are also possible, less preferred though. As shown in FIG. 9, the ribs 48 can have a round profile 86 extending from two panels upwards panels 87. The height 84 of each rib 48 is still around 5 mm.

In both cases shown in FIGS. 8 and 9, distance 88 is equal to 4 mm.

The transverse ribs can also have a general shape of a triangle, the basis of the triangle being towards the surface of the glove, and the apex being turned towards the gripping part of the glove.

As shown in FIG. 7, the distance 49 between two successive ribs 48 is equal to 5 mm approximately.

FIG. 7 shows that preferentially the ribs 48 are situated on the whole surface between the main pocket 20 and the secondary pocket 30. The ribs are present on the surface of the zone where the two pockets connect. This adds protection against heat when a body is near this zone.

Transverse ribs 48 can also only be put on the front 25 and back 27 surfaces of the main and secondary pockets respectively.

Third Embodiment

Figure 10:
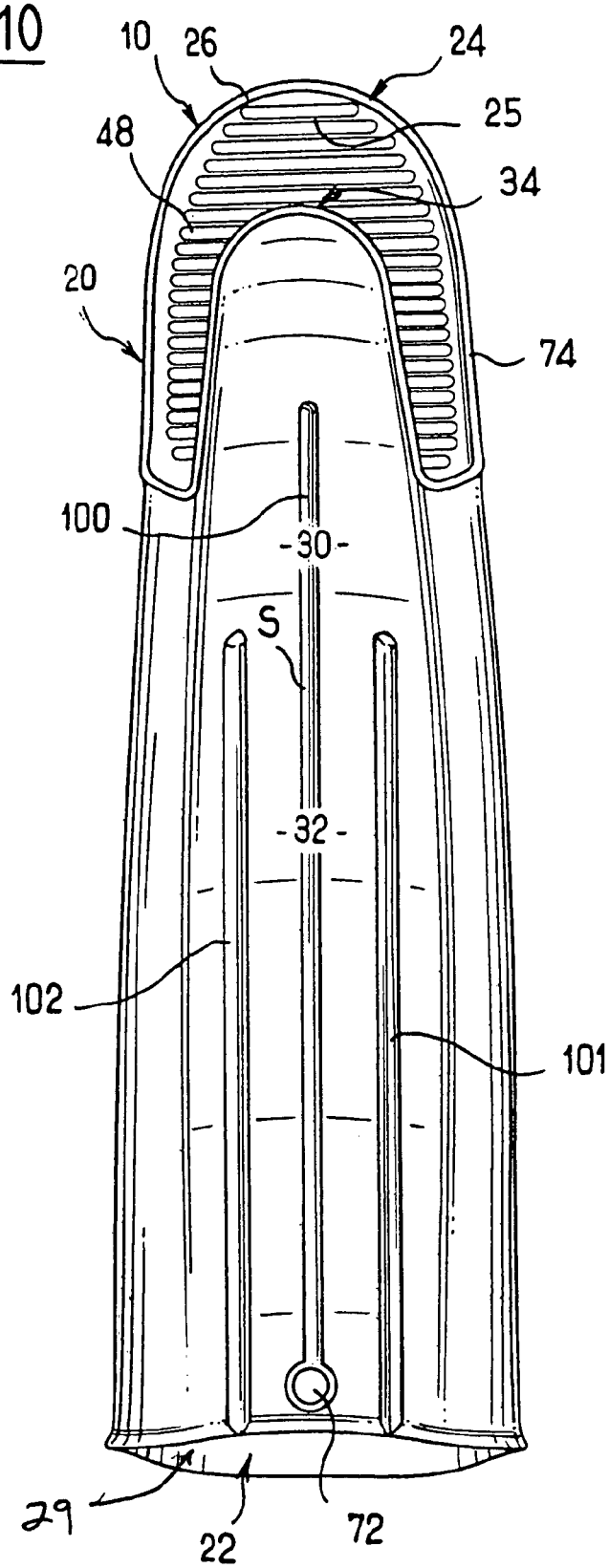
FIG. 10 is a first plan view of a third embodiment of a glove of the present invention, as seen from beneath.

According to a third embodiment, the glove 10 has still the same overall shape. A view of this third embodiment is shown in FIG. 10. The numerical references show the similarities between the embodiments. The specification does not repeat the structure of the glove for clarity. For example, the main and the secondary pockets have longitudinal axes that are parallel to each other and through which passes a plane of symmetry S.

The main difference of this embodiment with the first two embodiments is that the glove 10 is longer.

The dimensions of the glove 10 are as follows.

- when flat, the length of the opening 22 is about 15 centimeters (cm);
- in use, the section of the opening 22 is about 40 square centimeters ($cm^2$);
- the total length of the main pocket is about 45 cm;
- the length of the secondary pocket 30 is about 8 cm;
- the length of the secondary pocket 30 in the flattened state, across its opening outline 32 where it joins the main pocket 20 is about 9 cm; and
- the width of the main pocket 20 in the flattened state, at a distance of about 20 cm from its opening 22 is about 15 cm.

The fact that the main pocket is longer and that the opening 22 is bigger allow the user to put his hand deeper in the glove. The main pocket 20 and the secondary pockets 30, once connected, form therefore a foresleeve. The glove 10 has in this third embodiment a sleeve covering the arm from the elbow to the wrist of a user.

Preferably, according to the third embodiment, the outer surface of the secondary pocket 30 has a projecting longitudinal central rib 100. The central rib is preferably associated to projecting longitudinal side ribs 101 and 102. Preferably, ribs 101 and 102 are symmetrical to each other with respect to the plane of symmetry S.

Rib 100 extends approximately on 35 cm from the eyelet 72.

Ribs 101 and 102 extend approximately on 25 cm from the opening 22. When flat, the distance between each rib 101 or 102 and the central rib 100 is 2.5 cm. Therefore, the distance between the two ribs 101 and 102 is 5 cm approximately. The height of the projecting ribs is approximately equal to 5 mm.

The cross-section-of the ribs is preferably semi-circular, to decrease the area of contact at the apex with hot bodies. The radius of curvature of the ribs is approximately 5 mm and the width of the ribs 101 and 102 is approximately equal to 10 mm and the width of central rib 100 is approximately equal to 5 mm.

Ribs 100, 101, and 102 are associated and allow the user to put hot bodies, such as plates for instance, on the foresleeve of the glove. The ribs diminish the surface in contact with the hot body, since only a small part situated on the apex touches the hot body, and will therefore protect the user. They also increase the thickness of the glove, which is at their location at least equal to 2.5 mm, and preferably equal to 5 mm.

The ribs 100, 101 and 102 reinforce as well the glove, and give rigidity to the foresleeve of the glove 10.

As already mentioned above, the third embodiment has the same other features as the other embodiments. For instance, it possesses an eyelet 72, and the structure of the inner surface 29 is cellular.

According to this third embodiment, the transverse ribs 48 are preferably of the type shown on FIG. 9.

The length of extension of the ribs 42, 100, 101 and 102 can be changed.

Rib 42 can be replaced by two or more longitudinal ribs.

One or more among longitudinal ribs 100, 101 and 102 can be omitted as well.

Fourth Embodiment

In the first three embodiments described in the specification, the longitudinal axes 70 and 71 of the pockets were mainly parallel.

Figure 12:
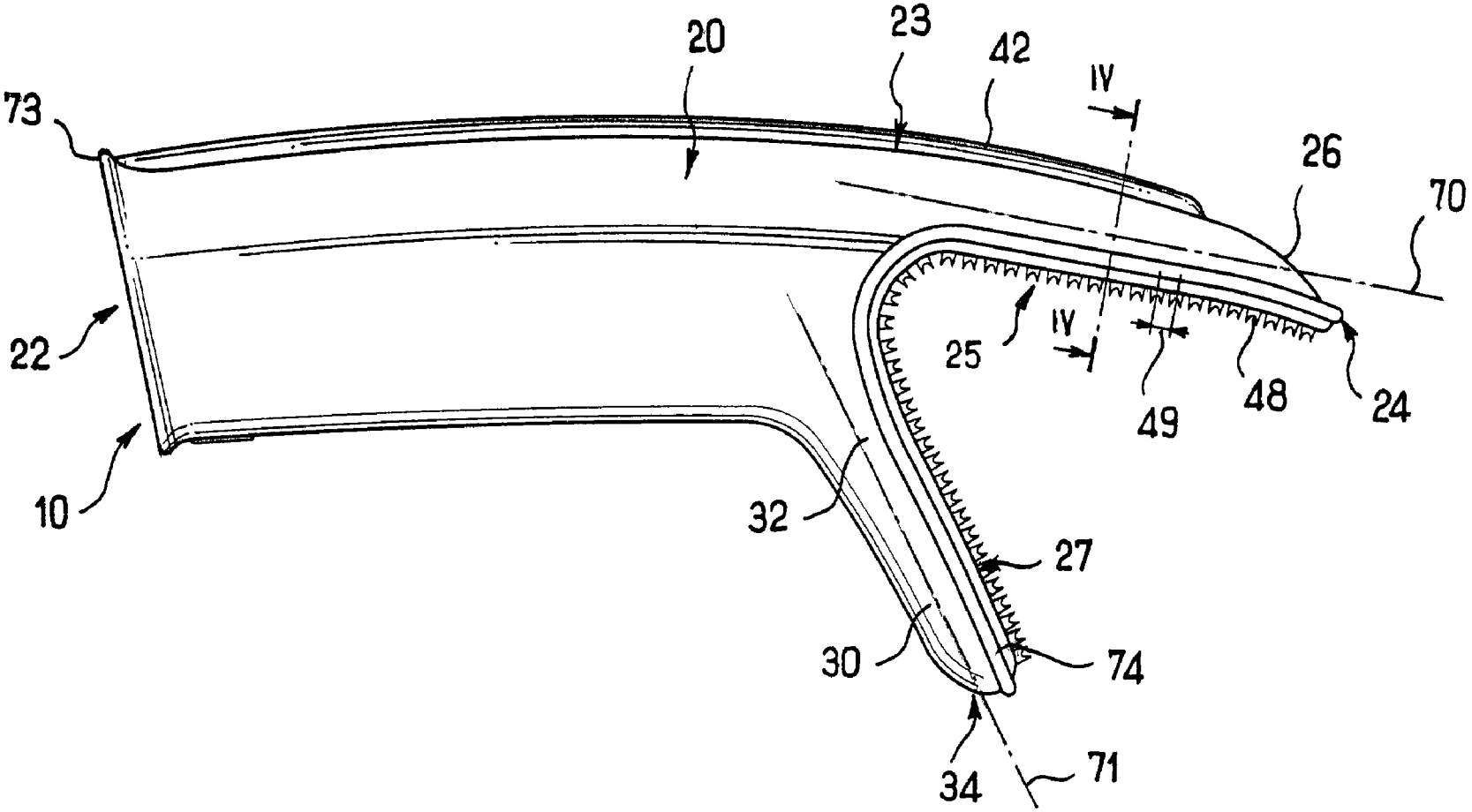
FIG. 12 is a side view of a fourth embodiment of a glove of the present invention.

In a fourth embodiment shown in FIG. 12, the axes 70 and 71 are not parallel. The angle between the two longitudinal axes 70 and 71 is approximately equal to 45°.

This angle enables the user to grab bigger hot bodies.

The glove according to the fourth embodiment has the main features as the first three embodiments, and is typically ambidextrous.

Fifth Embodiment

Figure 13:
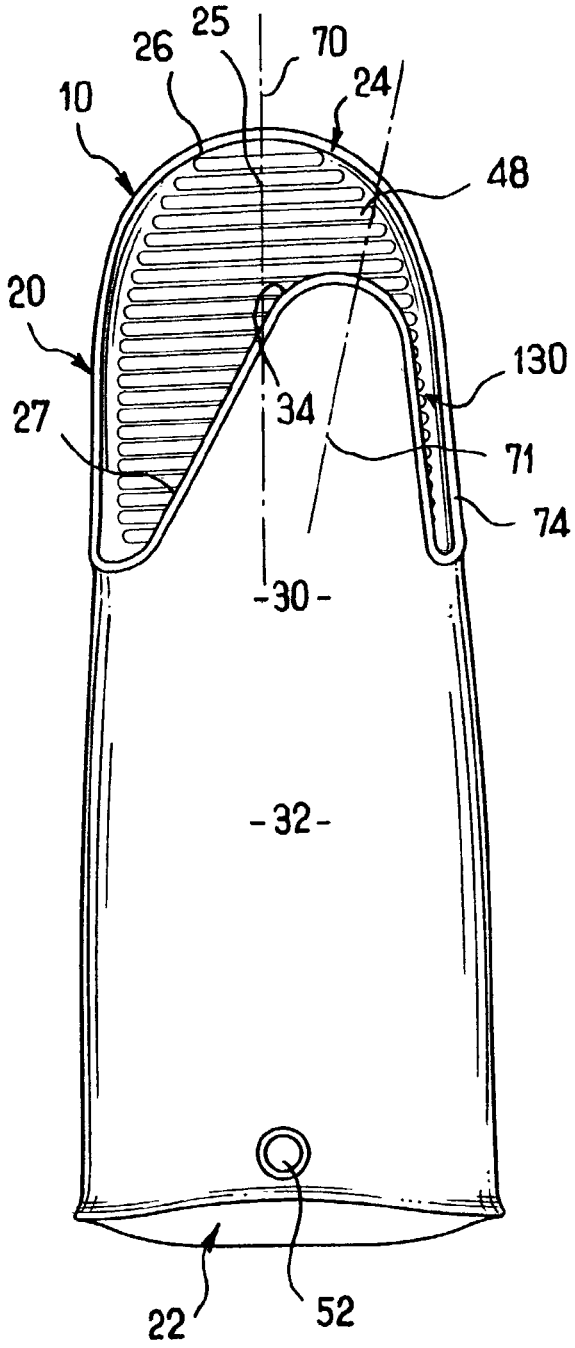
FIG. 13 a view of a fifth embodiment of a glove of the present invention, as seen from beneath.

A view of the fifth embodiment is shown in FIG. 13 as seen from beneath. According to the fifth embodiment, the glove 10 has the main features of the other embodiments, as the longitudinal rib extending on the back of the glove. It can have the length of the first embodiment or the length of the third embodiment. In the latter case, it has of course the longitudinal rib (referred to as 100 in FIG. 10) and extending on the front of the glove associated with the two longitudinal ribs (referred to as 101 and 102 in FIG. 10) described in the part of the specification dedicated to this embodiment. The description is not repeated here for clarity.

The main difference is therefore that the glove has no plane of symmetry. The glove 10 cannot be used either on the left-hand or on the right-hand of a user. For instance, the glove shown in FIG. 13 is for a right hand. The secondary pocket extends from where the two pockets connect towards left or right, and the two longitudinal axes 70 and 71 form an angle of at least 30°, and preferentially approximately 45° between each other, and in a direction parallel to the palm of the user when the glove is in use. The longitudinal axis of the main pocket is still in the continuation the axis of the arm when the glove is in use. It is the axis 71 of the secondary pocket that extends to the right or to the left, in a plane perpendicular to the palm of the user when the glove is in use.

Axes 70 and 71 are still parallel to each other with respect to a plane parallel to a plane passing through the palm of the user.

According to this embodiment, the thickness of the glove (in the front face 25 of the main pocket and the back face 27 of the secondary pocket), in the region corresponding to the thumb shown by 130, has a thickness of at least 2 mm, so as to allow improved heat protection when the user is holding a hot body. Preferentially, the thickness is of 5 mm. The increased thickness occurs therefore in the whole secondary pocket, and in the region of the main pocket that extends upwardly to a distance of 5 cm from the zone where the two pockets connect. The region of increased thickness in the main pocket corresponds to the zone opposite the region of the thumb. This located increase avoids the increase of thickness where not needed.

The ribs 48 are of the type of FIG. 9 preferably, but can be of the type of FIG. 10 as well.

Of course the thickness of the main and secondary pocket can be increased in the whole region of the gripping part, that is to say outside the region 130.

In the same manner as before, the longitudinal axes 70 and 71 can be no more parallel to each other in a plane perpendicular to the palm of the user when the glove is in use, and form an angle like in the fourth embodiment in this plane.

Sixth Embodiment

Figure 14:
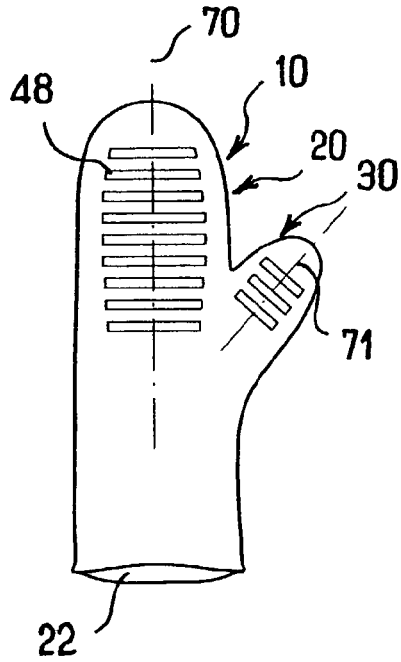
FIG. 14 is a view from beneath of a glove according to a sixth embodiment.

A sixth embodiment is shown schematically as seen from beneath in FIG. 14. It has the same main features as the glove of the other embodiments, and is quite similar to the fifth embodiment.

Figure 15:
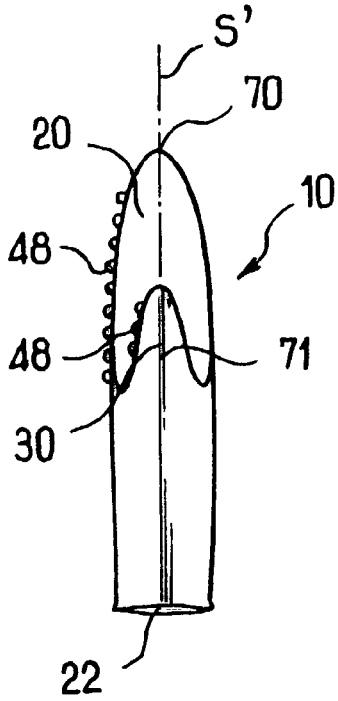
FIG. 15 is a side view of the glove shown in FIG. 14.

The main difference is that according to the sixth embodiment, the secondary pocket 30 is situated in the plane of FIG. 14, that is to say in the plane S' shown in FIG. 15 and passing through the palm of the user when the hand is in the glove 10. The axes 70 and 71 are in that plane S' and form an angle of approximately 45°.

The glove according to the sixth embodiment is not ambidextrous. It has no plane of symmetry perpendicular to the plane S' of the palm or the main pocket 20.

Preferentially the glove 10 possesses a grip on the surface that is dedicated to the handling of hot bodies. The grip is constituted by transverse ribs 48. The glove 10 shown in FIG. 14 and 15 are for the right hand due to the transverse ribs 48 on the front surfaces of the main 20 and secondary 30 pockets. The transverse ribs can be of any type described in the present specification.

The glove of the present invention presents numerous properties and advantages compared with known gloves, in particular, it:

is leakproof;
is insulating;
does not melt;
is machine washable;
is non-slip;
is ambidextrous;
does not burn; and
does not blacken.

Naturally, the present invention is not limited to the particular embodiment described above but extends to any variant in compliance with the spirit of the invention.

For example, the glove of the present invention can be fitted close to the opening 22 with a strap 50 for making it easier to keep the glove on the wrist.

Figure 5:
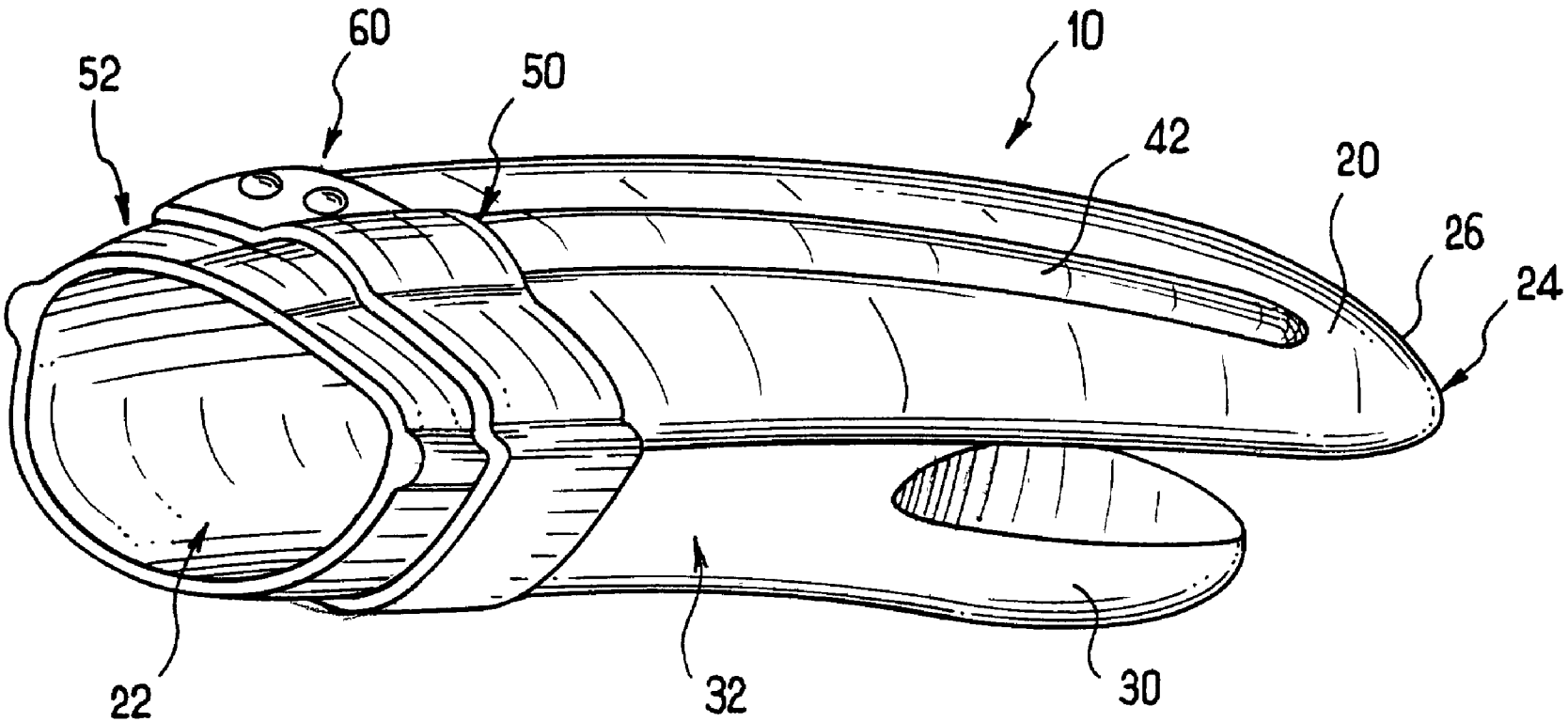
FIG. 5 is a perspective view of a variant glove in accordance with the present invention.

This strap can comprise two elements that are connected to the glove in a spaced-apart configuration and they have respective complementary fastener elements (e.g. of the hook/velvet, stud/slot, button, etc. type) enabling the strap to be adjusted to the size of the wrist. Or as shown in FIG. 5, the strap can comprise a single element having a first end 52 fixed to the glove and provided with fastening means 60 of the kind mentioned above and its second end for co-operating with complementary means provided on the glove, preferably close to the location where the first end 52 is fixed thereto (and preferably on the back of the glove). The strap 50 can be made of silicone, being integrally molded with the glove, or it can be constituted by a separate element fixed to the glove by any appropriate means.

The man skilled in the art will understand that other embodiments of the invention are possible, combining the main properties and features of the described embodiments for instance.

The invention claimed is:

1. A glove, in particular for housework, the glove being made integrally of silicone material comprising a main pocket designed to receive four fingers of a user, and a secondary pocket designed to receive the thumb, said secondary pocket opening out into the main pocket, the glove having inside and outside surfaces and including projecting ribs or reinforcement on at least one of the inside and outside surfaces of the glove, wherein the outer surfaces of the main and secondary pocket possess transverse ribs and the transverse ribs have a cross section having a shape of an 'M'.

2. A glove, in particular for housework, the glove being made of silicone material comprising a first pocket designed to receive at least one finger of a user, and a second pocket designed to receive a thumb of the user, said second pocket opening out into the first pocket, a gripping surface of at least one of said first and second pockets including a set of parallel ribs, each of the ribs including two longitudinally disposed side surfaces extending from said at least one of said first and second pockets, and a central surface disposed between the two side surfaces, the central surface being disposed between the side surfaces at a height lower than heights of the side surfaces relative to said at least one of said first and second pockets.

3. A glove according to claim 2, wherein the central surface of each of the ribs is adapted to allow circulation of air within the respective rib during use of the glove.

4. A glove according to claim 2, wherein the central surface of each of the ribs extends approximately 4 mm from said at least one of said first and second pockets and each of the side surfaces extends approximately 5 mm from said at least one of said first and second pockets.

5. A glove according to claim 2, wherein the side surfaces of each of the ribs converge upwards to respective climax points, each of the ribs further including two inner side surfaces converging downward from the respective climax points; the two inner side surfaces converging downward to the central surface.

6. A glove according to claim 5, wherein the two inner side surfaces and the central surface of each of the ribs defines a space adapted to allow circulation of air during use of the glove.

7. A glove according to claim 2, wherein gripping surfaces of both the first and second pockets includes respective sets of parallel ribs.

* * * * *